United States Patent [19]

Yamada

[11] Patent Number: 4,915,065

[45] Date of Patent: Apr. 10, 1990

[54] VALVE ACTUATION DEVICE FOR MULTI-VALVE TYPE ENGINE

[75] Inventor: Tetsuro Yamada, Iwata, Japan

[73] Assignee: Yamaha Hatsudoki Kabushiki Kaisha, Iwata, Japan

[21] Appl. No.: 295,551

[22] Filed: Jan. 10, 1989

[30] Foreign Application Priority Data

Jan. 11, 1988 [JP] Japan ..... 63-2415

[51] Int. Cl.[4] ..... F01L 1/02

[52] U.S. Cl. ..... 123/90.27; 123/308

[58] Field of Search ..... 123/90.27, 90.22, 90.6, 123/308, 432

[56] References Cited

U.S. PATENT DOCUMENTS 4,319,548 3/1982 Krüger ..... 123/90.27
4,593,657 6/1986 Aoi et al. ..... 123/90.27
4,624,222 11/1986 Yoshikawa ..... 123/90.27
4,632,073 12/1986 Futakuchi ..... 123/90.27
4,637,356 1/1987 Kuroda ..... 123/90.27
4,697,554 10/1987 Bothwell ..... 123/193 H

FOREIGN PATENT DOCUMENTS 0063385 10/1982 European Pat. Off. .
3524622 1/1987 Fed. Rep. of Germany .

*Primary Examiner*—Charles J. Myhre
*Assistant Examiner*—Weilun Lo
*Attorney, Agent, or Firm*—Ernest A. Beutler

[57] ABSTRACT

Two embodiments of valve driving arrangements for internal combustion engines that permit a low camshaft positioning without adding to the width of the engine. In each embodiment, three intake valves are slidably supported, two in a common plane and the third in a plane that intersects the first plane along a line that is disposed farther from the valve heads than the rotational axis of the camshaft which operates the valves.

4 Claims, 1 Drawing Sheet

VALVE ACTUATION DEVICE FOR MULTI-VALVE TYPE ENGINE

BACKGROUND OF THE INVENTION

This invention relates to a valve actuation device for multi-valve type engines and more particularly to an improved valve actuating device for such engines that provides a compact cylinder head configuration.

It has been known that the performance of an internal combustion engine can be significantly improved by using multiple valves for each cylinder of the engine. The use of multiple valves permits a greater power output for the engine because multiple valves can provide the same effective flow area with lower inertias. For this reason, four valve per cylinder engines are quite common. The performance of an engine can be improved even further by utilizing more than two valves for either the intake and/or exhaust functions. However, as the number of valves increase, there is a difficulty in providing both a compact combustion chamber and one which has a relatively small surface area. Compact combustion chambers are desirable in order to maintain high compression ratios and small surface areas are required so as to prevent undue quenching. In addition, it is the normal practice to employ separate camshafts for driving the intake and exhaust valves. Where multiple camshafts and multiple valves are employed, the overall height and width of the engine can become quite large with conventional constructions.

There is shown in U.S. Letters Patents 4,624,222, issued Nov. 25, 1986, entitled "Intake Valve Structure For Internal Combustion Engine," issued in the name of Masaaki Yoshikawa, and assigned to the assignee of this application, an arrangement wherein a desired combustion chamber configuration can be enjoyed with multiple valves. In conjunction with the arrangement shown in that patent, there are provided three intake valves, two of which reciprocate about axes that lie in a common plane and the third of which reciprocates about an axis that is inclined to this plane. However, the axes intersect along a common line, which line coincides with the rotational axis of the actuating camshaft. Although this arrangement has numerous advantages, the camshaft tends to be relatively highly placed in the cylinder head and this can result in a higher engine height than is desirable. By canting the valves at a greater angle, the camshaft can be lowered but then the width of the engine will increase and the shape of the combustion chamber will not be as advantageous.

It is, therefore, a principal object of this invention to provide an improved arrangement for operating multiple valves of an internal combustion engine.

It is a further object of this invention to provide a valve actuating mechanism employing a camshaft wherein the camshaft is placed relatively low in the cylinder head so as to provide a low engine height and wherein the width of the cylinder head is not increased.

SUMMARY OF THE INVENTION

This invention is adapted to be embodied in a valve actuating arrangement for an overhead valve internal combustion engine having a pair of valves that reciprocate along axes that lie in planes which intersect along a line. A camshaft is rotatably journaled relative to the cylinder head and cooperates with the valves for actuating them. In accordance with the invention, the rotational axis of the camshaft is disposed closer to the heads of the valves than the line of intersection of the planes of reciprocation of the valves.

DETAILED DESCRIPTION OF THE PREFERRED EMBODIMENTS

Figure 1:
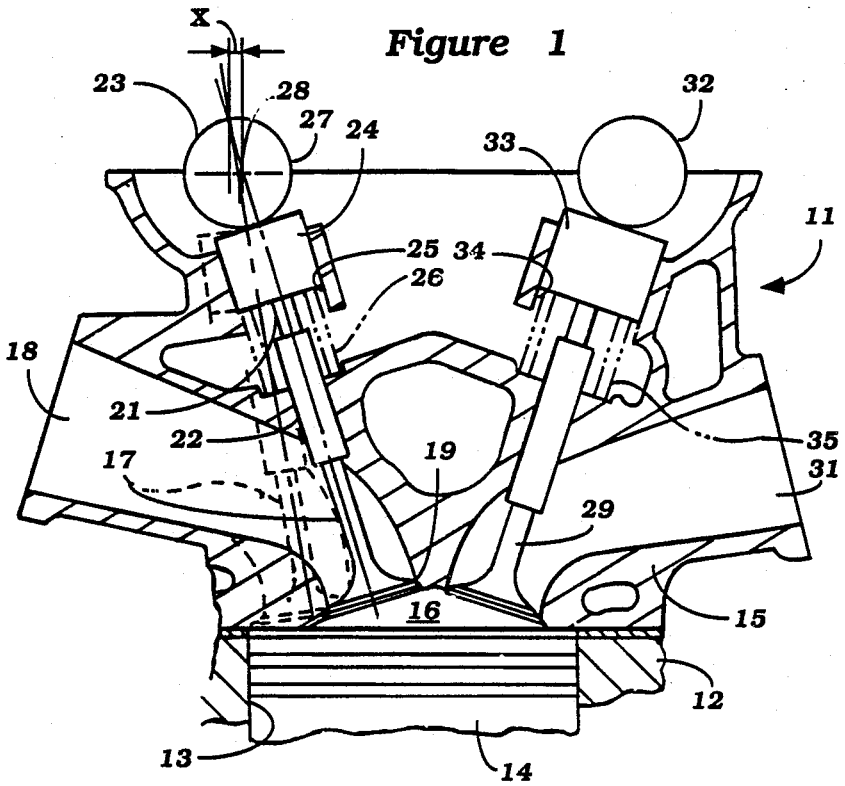
FIG. 1 is a partial cross-sectional view taken through the cylinder head and combustion chamber of a single cylinder of a multiple cylinder internal combustion engine constructed in accordance with an embodiment of the invention.

Referring in detail to the drawings, an internal combustion engine constructed in accordance with an embodiment of the invention is identified generally by the reference numeral 11. Only a portion of the engine 11 has been depicted and specifically only that portion of the engine dealing with the cylinder head and combustion chamber. In all other regards, the engine 11 may be considered to be conventional and, for that reason, it is not believed to be necessary to illustrate the remaining components of the engine. In addition, the illustration of only a single cylinder is believed to be all that is required for those skilled in the art to understand the invention.

The engine 11 is comprised of a cylinder block 12 in which one or more cylinder bores 13 are formed. Pistons 14 reciprocate in the cylinder bores 13 and are connected by means of connecting rods toa crankshaft (not shown) for driving the crankshaft in a known manner.

A cylinder head, indicated by the reference numeral 15, is affixed to the cylinder block 12 in a known manner. The cylinder head 15 has individual recesses 16 that cooperate with the cylinder bores 13 and pistons 14 to describe variable volume chambers, sometimes hereinafter referred to as "combustion chambers".

The engine 11 is provided with an induction system that is comprised of three intake valves, indicated generally by the reference numerals 17, which control the flow of an intake charge delivered from intake passages 18 through intake valve seats 19 into the combustion chamber 16. The charge is supplied to the intake passages 18 in any suitable manner which may include an intake manifold and fuel injection system. The intake passages 18 may be siamesed or there may be an individual intake passage 18 for each valve seat 19. The heads and stems 21 of the valves 17 are disposed in a relationship as set forth in aforenoted U.S. Letters Patent 4,624,222 so as to provide a compact combustion chamber.

The valves 17 have individual valve stems 21 that are slidably supported in valve guides 22 pressed into the cylinder head 15. As noted in aforenoted U.S. Pat. No. 4,624,222, two of the valve stems **21*a* are disposed at a greater angle to the axis of the cylinder bore 13 than the remaining valve stem 21*b*. The valve stems 21*a* lie in a common plane and this plane is intersected by a plane containing the valve stem axis 21*b* along a line 23**.

Thimble type tappets 24 are slidably supported in bores 25 of the cylinder head 13 and cooperate with the tips of the valve stems 21 for opening the valves 17 in a known manner. Coil compression springs 26 encircle the valve stems 21 and urge the valves 17 toward their closed positions.

In accordance with the invention, the intake valves 17 are all operated by means of a single intake camshaft 27 that is rotatably journaled in the cylinder head 15 about a rotational axis 28 which lies closer to the valveseats 19 than the line of intersection 23 of the aforedescribed planes containing the axes of reciprocation of the valve stems 21. As a result, the overall cylinder head height can be reduced from that which would be present if the rotational axis 28 intersected the line of intersection 23 and, as will be apparent, the width of the cylinder head can also be reduced because the camshaft rotational axis is offset inwardly toward the cylinder bore axis by the distance X.

Figure 2:
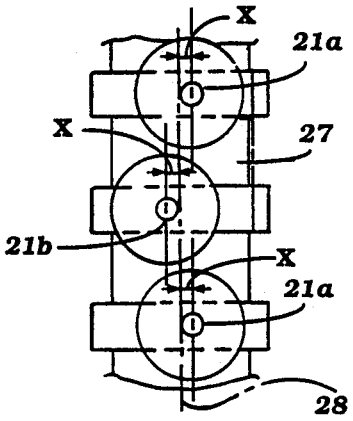
FIG. 2 is a plan view showing the relationship between the valves, valve actuators and camshaft rotational axis.
Figure 3:
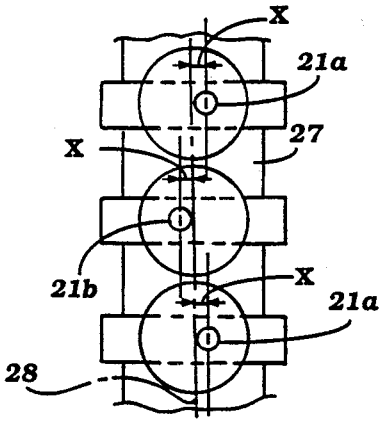
FIG. 3 is a plan view, in part similar to FIG. 2, showing another embodiment of the invention.

As a result of this configuration, it will be noted that if the thimble tappets 24 are coaxial with the valve stems 21, the point of engagement of the lobes of the camshaft 27 with the heads of the thimble tappets 24 will be offset by the distance X as clearly shown in FIG. 2. This does not present any significant problem since the thimble tappets 24 may be made large enough so as to avoid any significant cocking forces. Alternativley, as shown in FIG. 3, it is possible to keep the point of contact of the cam lobes with the thimble tappets at the center of the thimble tappets if the thimble tappets 24 are offset by the distance X from the center of the valve stems 21a and 21b. Again, this amount of offsetting is so slight that it will not prevent any difficulties in connection with the operation.

The combustion chamgber is completed by means of a pair of exhaust valves 29 that control the flow through exhaust ports 31. The exhaust valves 29, which may reciprocate about axes that lie in a common plane, are operated by means of an exhaust valve camshaft 32 that cooperates with thimble tappets 33 that are slightly supported in bores 34 of the cylinder head 15. Exhaust valve springs 35 urge the exhaust valves 29 to their closed positions.

It should be readily apparent from the foregoing description that the described valve actuating arrangement permits a very simple and compact valve assembly with the desired combustion chamber configuration without increasing the height or width of the engine and specifically of the cylinder head. Although two embodiments of the invention are illustrated and described, various changes and modifications may be made without departing from the spirit and scope of the invention, as defined by the appended claims.

I claim:

1. In a cylinder head construction for an internal combustion engine comprising a rotatable camshaft journaled about an axis, a pair of valves having their stem portions slidably supported in the cylinder head for reciprocation about respective non-parallel reciprocal axes that lie in planes that intersect at a line spaced further from the tips of said valves than said camshaft axis, and thimble tappets interposed between said camshaft and said valve tips for operating said vlaves from said camshaft, said thimble tappets having respective central axes of reciprocation offset from the respective reciprocal axes of said valve stems.

2. In a cylinder head construction as set forth in claim 1 wherein there are three valves operated by the camshaft and two of the valves reciprocate along axes that lie in a common plane.

3. In a cylinder head construction as set forth in claim 2 wherein the valves all serve the same function for the engine.

4. In a cylinder head construction as set forth in claim 3 wherein the valves are all intake valves.

* * * * *